US008210858B2

(12) United States Patent
Lee et al.

(10) Patent No.: US 8,210,858 B2
(45) Date of Patent: Jul. 3, 2012

(54) SOCKET DEVICE COMPRISING GROUNDING STRUCTURE, APPLICATION OF SOCKET DEVICE AND MANUFACTURING METHOD THEREOF

(75) Inventors: Kuo-Liang Lee, Taoyuan Hsien (TW); Juin-Kai Chuang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 35 days.

(21) Appl. No.: 12/965,671

(22) Filed: Dec. 10, 2010

(65) Prior Publication Data

US 2011/0143560 A1 Jun. 16, 2011

(30) Foreign Application Priority Data

Dec. 11, 2009 (TW) ..... 98142598 A

(51) Int. Cl.
*H01R 4/66* (2006.01)

(52) U.S. Cl. ..... 439/108; 439/92

(58) Field of Classification Search ..... 439/92, 439/97, 108, 782, 801, 810–815
See application file for complete search history.

(56) References Cited

U.S. PATENT DOCUMENTS

| | | | | |
|---|---|---|---|---|
| 4,802,863 | A * | 2/1989 | Debus | 439/387 |
| 6,877,996 | B1 * | 4/2005 | Franks, Jr. | 439/92 |
| 7,241,152 | B2 * | 7/2007 | Charrier et al. | 439/97 |
| 7,452,219 | B2 * | 11/2008 | Kitajima et al. | 439/92 |
| 7,462,042 | B2 * | 12/2008 | Chawgo | 439/97 |
| 7,731,512 | B1 * | 6/2010 | Montena et al. | 439/108 |
| 2010/0203748 | A1 * | 8/2010 | Wason et al. | 439/98 |

* cited by examiner

*Primary Examiner* — Thanh Tam Le

(57) ABSTRACT

One embodiment of the present invention relates to a socket device comprising a base, a socket structure and a grounding structure. The base comprises a substrate and a sidewall adjacent thereto, and the substrate comprises a first lateral and a second lateral corresponded to each other. The socket structure is disposed on the sidewall of the base. The grounding structure is disposed on the substrate of the base and comprises a grounding element, a fixing element, a grounding wire, and an insulating plate. The grounding element comprises first and second terminals, wherein the first terminal is protruded from the first lateral of the substrate. The fixing element is substantially disposed on the second lateral of the substrate and connected to the second terminal of the grounding element, so as to fix the grounding element to the substrate.

14 Claims, 10 Drawing Sheets

SOCKET DEVICE COMPRISING GROUNDING STRUCTURE, APPLICATION OF SOCKET DEVICE AND MANUFACTURING METHOD THEREOF

CLAIM OF PRIORITY

This application claims priority to Taiwanese Patent Application No. 098142598 filed on Dec. 11, 2009.

FIELD OF THE INVENTION

The present invention relates to a socket device comprising grounding structure and application and manufacturing method of said socket device; more particularly to a small size and easily manufactured socket device comprising grounding structure, the application of said socket device, and manufacturing method of said socket device.

BACKGROUND OF THE INVENTION

Generally speaking, most of electronic apparatus have grounding structure to prevent users from danger. Take adapter for example, it comprises a main body and a socket device. The main body is applied to receive circuit board therein, and the socket device comprises grounding structure. Since grounding structure belongs to the secondary side and electronic components disposed in the main body of the adapter belongs to the primary side, the area close to the grounding structure at the interior of the main body is usually covered by an insulating shell, and a conducting piece is extended from the edge of the insulating shell for connecting to a wire, so as to ground via the wire connecting to the circuit board. With the insulating shell covering the grounding structure, an electrical safety distance can be maintained between the grounding structure and the electronic components. To further prevent the contact between the conducting piece of the grounding structure and the electronic components disposed on the circuit board, an insulating tube has to be sheathed on the conducting piece exposed relative to the insulating shell and connected to the wire, so as to ensure electrical safety.

However, since the insulating shell is disposed in the main body, the interior space of the main body is usually occupied thereby, which is unfavorable for minimizing the volume of socket device and the adapter having such socket device. Besides, the manufacturing method for sheathing insulating tube on the conducting piece and the wire connected thereto is complex. If the insulating tube is pierced, electrical safety of the adapter will be affected.

Accordingly, it is required to develop a socket device comprising grounding structure, application of said socket device, and manufacturing method thereof to overcome the foregoing defects.

SUMMARY OF THE INVENTION

An object of the present invention is to provide a socket device comprising grounding structure, application of said socket device, and manufacturing method thereof. The grounding structure of the socket device comprises a grounding element, a fixing element, a grounding wire, and an insulating plate. The first conductive end of the grounding wire is connected to the fixing element, for example: the extension portion of the fixing element. The second terminal of the grounding element is fixed to the fixing element for placing a substrate between the grounding element and the fixing element. The insulating plate is flatly disposed on the substrate for covering the second terminal of the grounding element, the fixing element, and the first conductive end of the grounding wire. Thus the fixing element and the first conductive end of the grounding wire can be isolated by the insulating plate, and the problem of space occupied by the insulating shell can be avoided. In addition, the conducting wire is piercing through the insulating plate and forming a continuous insulating structure by the insulating layer thereof engaged with the insulating plate. Therefore, the insulating tube applied in the conventional structure can be omitted, and the creepage distance can be increased, so as to enhance electrical safety.

According to an aspect of the present invention, a socket device comprises a grounding structure is provided. The socket device comprises a base, a socket structure, and a grounding structure. The base comprises a substrate and a sidewall adjacent thereto. The substrate comprises first and second laterals corresponded to each other. The socket structure is disposed on the sidewall of the base. The grounding structure is disposed on the substrate of the base and comprises a grounding element, a fixing element, a grounding wire, and an insulating plate. The grounding element comprises a first terminal and a second terminal, and the first terminal is protruded from the first lateral of the substrate. The fixing element is substantially disposed on the second lateral of the substrate and connected to the second terminal of the grounding element, so as to fix the grounding element to the substrate. The grounding wire is connected to the fixing element by a first conductive end thereof. The insulating plate is substantially disposed on the second lateral of the substrate and covered the second terminal of the grounding element, the fixing element and the first conductive end of the grounding wire, wherein the grounding wire is piercing through and protruded relative from the insulating plate for grounding.

According to another aspect of the present invention, there is provided an electronic apparatus. The electronic apparatus comprises a main body and a socket device. The socket device comprises a base, a socket structure, and a grounding structure. The base defines a receiving space with the main body, so as to receive a circuit board. The base comprising a substrate and a sidewall adjacent thereto, and the substrate comprises a first lateral and a second lateral. The socket structure is disposed on the sidewall of the base. The grounding structure is disposed on the substrate of the base and comprises a grounding element, a fixing element, a grounding wire, and an insulating plate. The grounding element comprises a first terminal and a second terminal, wherein the first terminal is protruded from the first lateral of the substrate. The fixing element is substantially disposed on the second lateral of the substrate and connected to the second terminal of the grounding element, so as to fix the grounding element relative to the substrate. The grounding wire is connected to the fixing element by a first conductive end thereof. The insulating plate is substantially disposed on the second lateral of the substrate and covered the second terminal of the grounding element, the fixing element and the first conductive end of the grounding wire, wherein the grounding wire is penetrating through and protruded relative from the insulating plate, so as to connect to the circuit board for grounding.

According to the other aspect of the present invention, there is provided a manufacturing method of a grounding structure. The grounding structure is applied in a socket device, and the manufacturing method comprises steps of: (a) providing a grounding element and a fixing element; (b) providing a grounding wire and connecting a first conductive end of the grounding wire to the fixing element; and (c) assembling the grounding element and the fixing element with a substrate for placing the substrate between the grounding element and the fixing element, and covering the fixing element and the first conductive end of the grounding wire by an insulating plate, wherein the grounding wire is piercing through the insulating plate.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only; it is not intended to be exhaustive or to be limited to the precise form disclosed.

Figure 1:
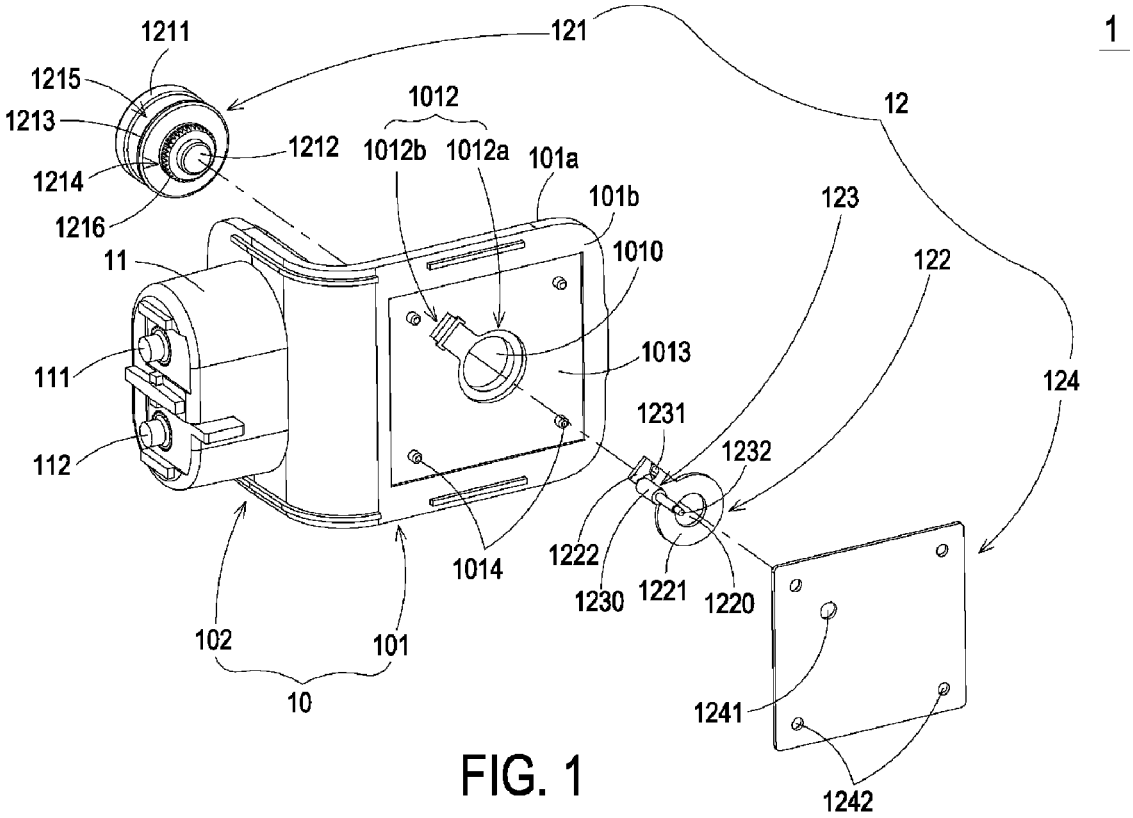
FIG. 1 is an exploded view showing the socket device comprising grounding structure according to a preferred embodiment of the present invention.
Figure 3A:
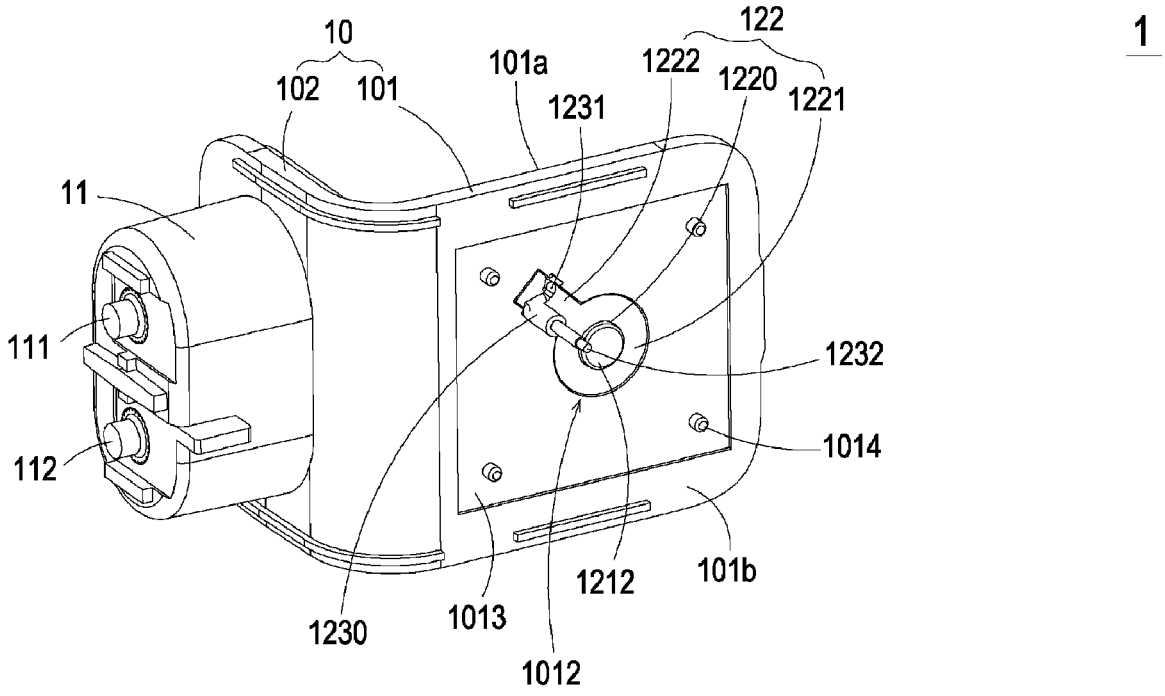
FIG. 3A is a schematic diagram showing the socket device during assembly according to FIG. 1 of the present invention.
Figure 3B:
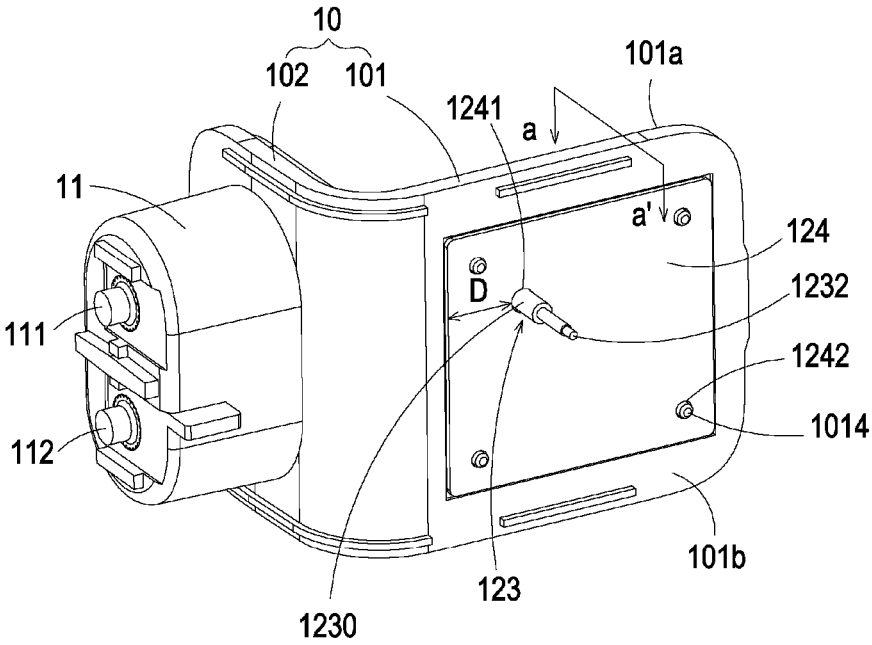
FIG. 3B is a schematic diagram showing the inner side of the assembled socket device according to FIG. 1 of the present invention.
Figure 3C:
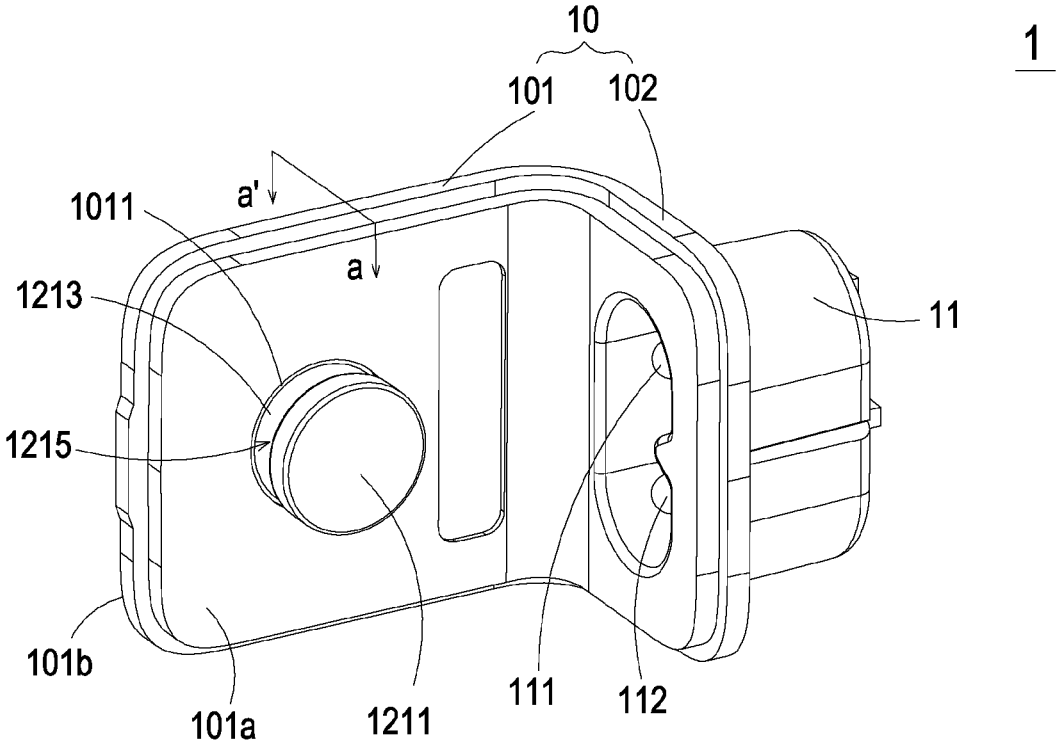
FIG. 3C is a schematic diagram showing the outer side of the assembled socket device according to FIG. 1 of the present invention.
Figure 3D:
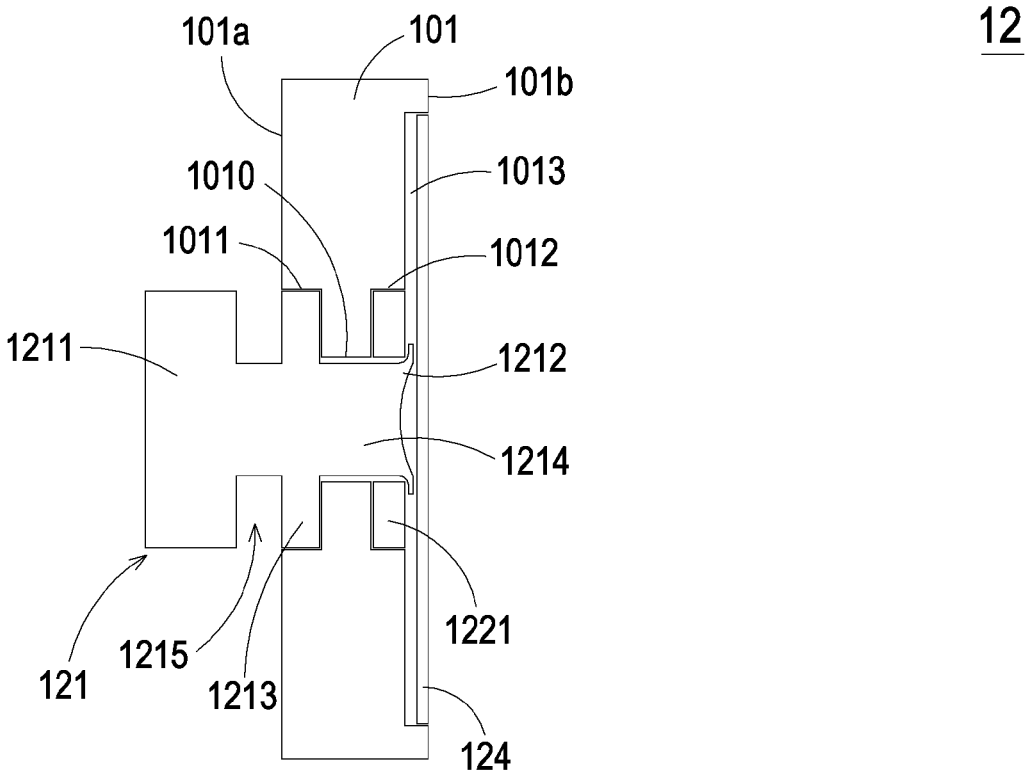
FIG. 3D is a schematic diagram showing a-a' section of the grounding structure of the socket device shown in FIGS. 3B and 3C of the present invention.

Please refer to FIG. 1, which is an exploded view showing the socket device comprising the grounding structure according to a preferred embodiment of the present invention. For easily describing, the socket device comprising grounding structure is represented as the socket device. As shown in FIG. 1, the socket device 1 comprises a base 10, a socket structure 11, and a grounding structure 12. The base 10 comprises substrate 101 and a sidewall 102 adjacent to the substrate 101, wherein the substrate 101 has a first lateral 101*a* and a second lateral 101*b* corresponding to each other. The socket structure 11 is disposed on the sidewall 102, and the grounding structure 12 is disposed on the substrate 101. The grounding structure 12 comprises a grounding element 121, a fixing element 122, a grounding wire 123, and an insulating plate 124. The grounding element 121 comprises a first terminal 1211 and a second terminal 1212, and the first terminal 1211 is protruded relative from the first lateral 101*a* of the substrate 101 (as shown in FIG. 3C). The fixing element 122 is substantially disposed on the second lateral 101*b* of the substrate 101 and connected to the second terminal 1212 of the grounding element 121, and thus the grounding element 121 can be fixed to the substrate 101 (as shown in FIG. 3D). The grounding wire 123 is connected to the fixing element 122 by the first conductive end 1231 thereof. The insulating plate 124 is substantially disposed on the second lateral 101*b* of the substrate 101 and covered the second terminal 1212 of the grounding element 121, the fixing element 122, and the first conductive end 1231 of the grounding wire 123 (as shown in FIG. 3B and FIG. 3D). The grounding wire 123 is penetrating through the insulating plate 124 and protruded relative from the insulating plate 124 (as shown in FIG. 3B) for grounding. The detail structure of the socket device 1 will be further described as follows.

Figure 5:
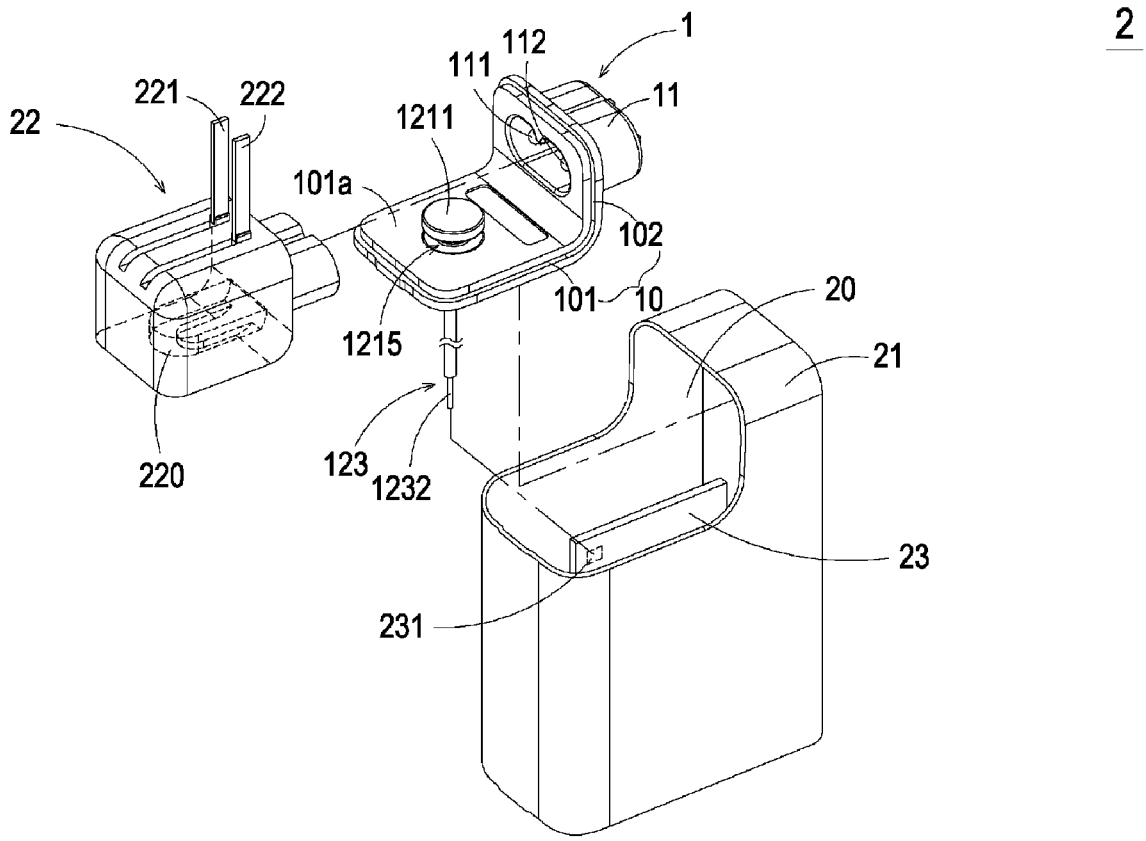
FIG. 5 is a schematic diagram showing the socket device comprising the grounding structure applied in an electronic apparatus according to a preferred embodiment of the present invention.

Please refer to FIG. 1 again. The grounding element 121 of the grounding structure 12 of the socket device 1 can be formed by conductive material, for example: metals such as copper or etc., and the surface of the grounding element 121 can be electroplated to avoid oxidation, but the material for forming the grounding element 121 is not limited thereto. The grounding element 121 further comprises a contact surface 1213, a neck 1214, and a groove 1215 disposed between the first terminal 1211 and the second terminal 1212. The contact surface 1213 is disposed between the first and second terminals 1211 and 1212, and the neck 1214 is disposed between the contact surface 1213 and the second terminal 1212 for connecting the second terminal 1212 and the contact surface 1213. Selectively, the neck 1214 comprises plural dents 1216 disposed thereon for enhancing engagement strength. The groove 1215 can be disposed between the first terminal 1211 and the contact surface 1213 for guiding the plug 22 of an electronic apparatus 2 to the exact position while the socket device 1 is applied in the electronic apparatus 2 (as shown in FIG. 5). In this embodiment, the first terminal 1211, the second terminal 1212, the contact surface 1213, and the neck 1214 are substantially round shape structures, wherein the diameters of the first terminal 1211 and the contact surface 1213 are preferably equal but larger than the diameters of the neck 1214 and the second terminal 1212. The contact surface 1213 can prop against the substrate 101 when the grounding element 121 is assembled to the substrate 101.

Please refer to FIG. 1, the fixing element 122 of the grounding structure 12 can be formed by conductive material, such as metals like copper and etc., but not limited thereto. The fixing element 122 comprises a fixing portion 1221 and an extension portion 1222. The fixing portion 1221 is substantially a round-shape plate, and an opening 1220 is disposed at the center thereof. The diameter of the opening 1220 is corresponded to the diameter of the second terminal 1212 of the grounding element 121. The extension portion 1222 is coplanarly extended from the edge of the fixing portion 1221, wherein the shape of the extension portion 1222 can be rectangular, but not limited thereto. The grounding wire 123 is selected from a conducting wire with insulating layer 1230 wrapped outside and comprises a first conductive end 1231 and a second conductive end 1232. The first conductive end 1231 and the second conductive end 1232 are corresponded to each other. The insulating layer 1230 is disposed between the first and second conductive ends 1231 and 1232. In other words, the first and second conductive ends 1231 and 1232 are exposed relative to the insulating layer 1230, so as to connect to the extension portion 1222 of the fixing element 122 by the first conductive end 1231 and grounding by the second conductive end 1232.

As regards the insulating plate 124 of the grounding structure 12, it is a flat rectangular plate (as shown in FIG. 1), and the insulating plate 124 is preferably selected from an insulating pad or insulating tape made of rubber or plastic. But it is to be understood that the shape and material of the insulating plate 124 is not limited, any flat plate having insulating ability can be applied as the insulating plate 124 of the present invention. In this embodiment, the insulating plate 124 further comprises an aperture 1241 for the grounding wire 123 to penetrate therethrough. In addition, for firmly fixing the insulating plate 124 on the second lateral 101*b* of the substrate 101, at least a through hole 1242 can be disposed on the insulating plate 124. For example, the rectangular insulating plate 124 comprises four through holes 1242 respectively located at four corners thereof.

The grounding structure 12 can be disposed on the substrate 101 of the base 10 of the socket device 1. As shown in FIG. 1, the base 10 of the socket device 1 comprises a substrate 101 and a sidewall 102. The substrate 101 and the sidewall 102 are preferably integrally formed by injection molding, but not limited thereto. In this embodiment, the sidewall 102 is adjacent to and substantially perpendicular to the substrate 101. The sidewall 102 has the socket structure 11 disposed thereon, wherein the socket structure 11 comprises a first pin 111 and a second pin 112. The substrate 101 has a hollow portion 1010 penetrating through the first and second laterals 101*a* and 101*b* thereof. The bore of the hollow portion 1010 is approximately equal to the diameter of the neck 1214 of the grounding element 121. The first lateral 101*a*, for example: the exterior lateral, of the substrate 101 comprises a first indentation 1011 surrounding the hollow portion 1010 and being depressed from the first lateral 101*a* (as shown in FIG. 3D). The shape and size of the first indentation 1011 is cooperated with the contact surface 1213 of the grounding element 121. Since the contact surface 1213 is a round shape structure, it is to be understood that the first indentation 1011 is preferably a round indentation, wherein the diameter and the depth of the first indentation 1011 are respectively corresponded to the diameter and the thickness of the contact surface 1213 of the grounding element 121. Accordingly, the contact surface 1213 can be received in the first indentation 1011 when the grounding element 121 is assembled to the substrate 101. The second lateral 101*b* of the substrate 101, for example: the interior lateral, comprises a second indentation 1012 surrounding the hollow portion 1010 and being depressed from the second lateral 101*b*. The second indentation 1012 has a first part 1012*a* and a second part 1012*b*. The first part 1012*a* is corresponded to the fixing portion 1221 of the fixing element 122, and the second part 1012*b* is substantially rectangular and comprises a trench corresponded to the extension portion 1222 and the first conductive end 1231 of the grounding wire 123 connected to the extension portion 1222 of the fixing element 122. In addition to the second indentation 1012, the substrate 101 further comprises a receiving portion 1013 disposed on the second lateral 101*b* thereof. The receiving portion 1013 is depressed from the second lateral 101*b* and disposed around the second indentation 1012. That is to say, the second indentation 1012 is substantially disposed in the receiving portion 1013 and depressed from the bottom surface of the receiving portion 1013. The shape and the size of the receiving portion 1013 are corresponded to the insulating plate 124, and at least one protrusion 1014 is disposed in the receiving portion 1013. The protrusion 1014 is corresponded to the through hole 1242 of the insulating plate 124. For example, since in this embodiment, the insulating plate 124 is rectangular and comprises four through holes 1242, the receiving portion 1013 can be designed as rectangular shape and comprises four protrusions 1014 respectively located at four corners of the receiving portion 1013.

Figure 2A:
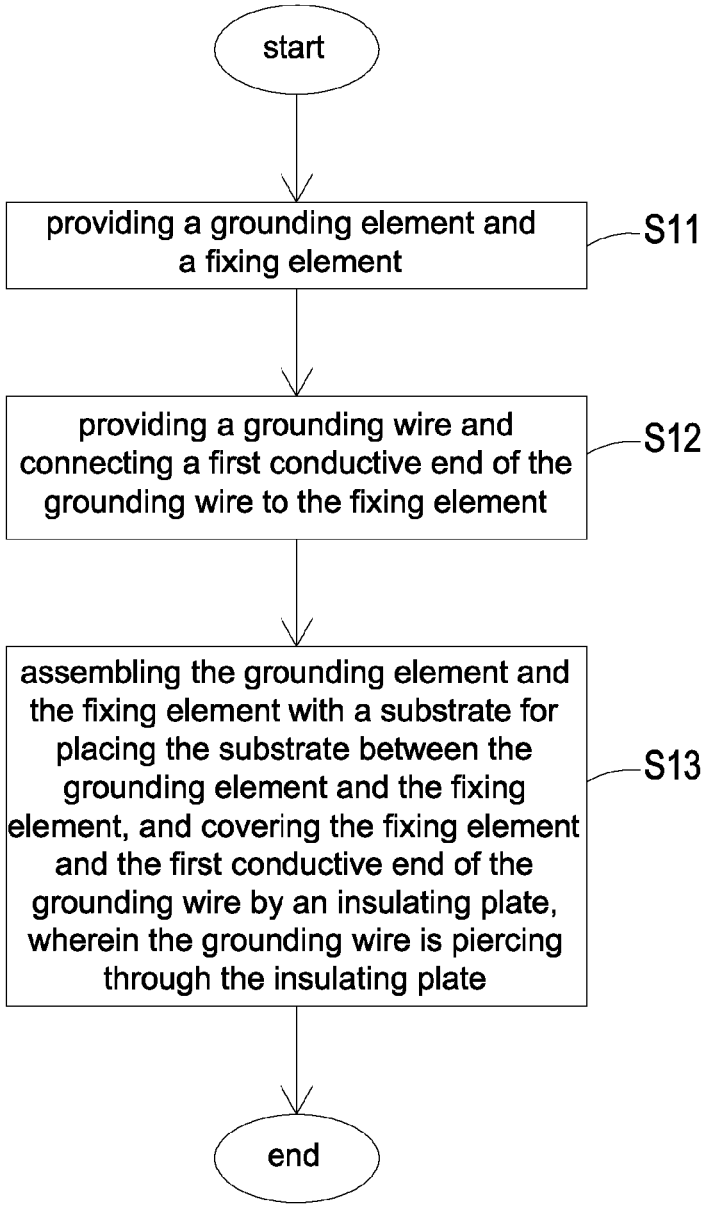
FIG. 2A is a flow chart showing the manufacturing method of the grounding structure applied in the socket device according to a preferred embodiment of the present invention.
Figure 2B:
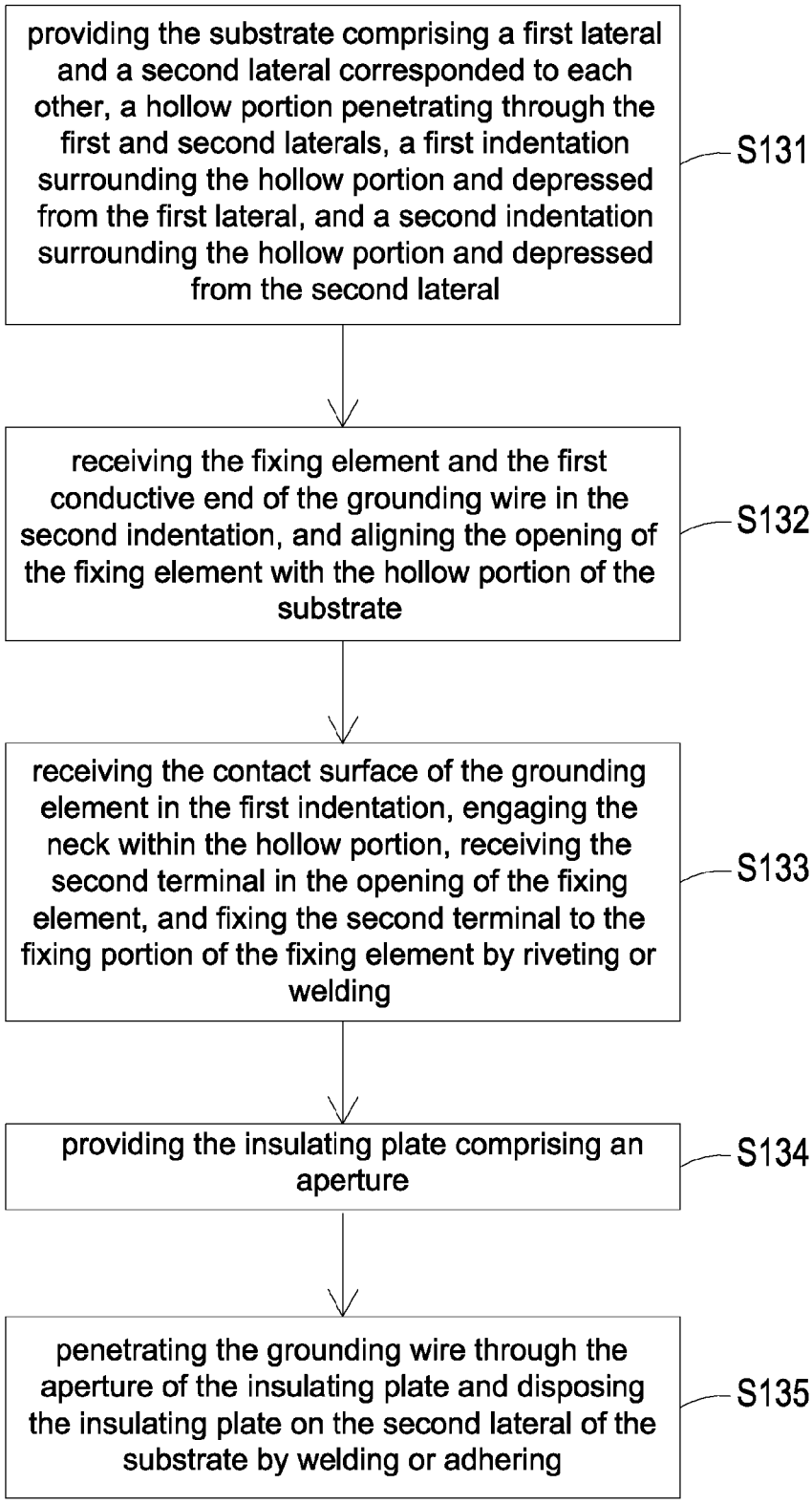
FIG. 2B is a flow chart showing sub steps of step S13 in FIG. 2A according to one embodiment.

The manufacturing method of the grounding structure applied in the socket device of FIG. 1 is shown in FIGS. 2A and 2B, wherein FIG. 2A is a flow chart showing the manufacturing method of the grounding structure applied in the socket device according to a preferred embodiment of the present invention, and FIG. 2B is a flow chart showing sub steps of step S13 in FIG. 2A according to one embodiment. To configure the grounding structure 12, a grounding element 121 and a fixing element 122 are applied (step S11), wherein the structures of the grounding element 121 and the fixing element 122 are shown in FIG. 1 and thus they are not redundantly described. The grounding wire 123 is applied, and the first conductive end 1231 of the grounding wire 123 is connected to the fixing element 122 (step S12). For example, the first conductive end 1231 of the grounding wire 123 can be connected to the extension portion 1222 of the fixing element 122 via winding, clipping or welding, but the methods for connecting the first conductive end 1231 and the extension portion 1222 are not limited. Subsequently, in step S13, the grounding element 121 and the fixing element 122 are assembled with a substrate 101, so as to place the substrate 101 between the grounding element 121 and the fixing element 122. In addition, the fixing element 122 and the first conductive end 1231 of the grounding wire 123 are covered by an insulating plate 124, wherein the grounding wire 123 is partially piercing through the insulating plate 124.

The sub steps of step S13 according to one preferred embodiment are shown in FIG. 2B. A substrate 101 is provided (step S131), and the structure of the substrate 101 is shown in FIG. 1. The fixing element 122 and the first conductive end 1231 of the grounding wire 123 are received in the second indentation 1012 at the second lateral 101*b* of the substrate 101, wherein the opening 1220 of the fixing element 122 is aligned with the hollow portion 1010 of the substrate 101 (step S132). In the embodiment shown in FIG. 1, since the second indentation 1012 comprises first and second parts 1012*a* and 1012*b*, the fixing portion 1221 of the fixing element 122 can be correspondingly received in the first part 1012*a* and the extension portion 1222 of the fixing element 122 with the first conductive end 1231 of the grounding wire 123 connected thereon can be received in the second part 1012*b*. Thus the fixing element 122 and the first conductive end 1231 of the grounding wire 123 can be flatly received in the second indentation 1012 and substantially at the same level with the bottom surface of the receiving portion 1013 (as shown in FIG. 3A). In step S133, the grounding element 121 is disposed on the substrate 101. The contact surface 1213 is received in the first indentation 1011 at the first lateral 101*a* of the substrate 101 (as shown in FIG. 3D), and the neck 1214 and the second terminal 1212 are penetrated through the hollow portion 1010 of the substrate 101. Since the diameter of the neck 1214 substantially equals to the bore of the hollow portion 1010, the neck 1214 is engaged within the hollow portion 1010 (as shown in FIG. 3D) and firmly fixed within the hollow portion 1010 by improving friction via the dents 1216 provided on the neck 1214. As regards the second terminal 1212 of the grounding element 121, it is received in the opening 1220 of the fixing element 122 (as shown in FIGS. 3A and 3D). The second terminal 1212 can be further fixed to the fixing portion 1221 of the fixing element 122 via riveting or welding, but not limited thereto. The insulating plate 124 comprising an aperture 1241 is provided (step S134). Then the grounding wire 123 is piercing through the aperture 1241 and protruded relative from the insulating plate 124, wherein the insulating plate 124 can be firmly disposed on the second lateral 101*b* of the substrate 101 via welding or adhering (step S135). For example, in step S135, the second conductive end 1232 of the grounding wire 123 is penetrated through the aperture 1241 of the insulating plate 124, and the insulating layer 1230 is engaged with the aperture 1241, so as to form a continuous insulating structure. The protrusions 1014 of the receiving portion 1013 can be received in the through holes 1242, and the insulating plate 124 can be further fixed in the receiving portion 1013 at the second lateral 101*b* of the substrate 101 (as shown in FIG. 3D) by ultrasonic welding or adhering by adhesive (not shown). Thus the grounding structure 12 can be fixed on the substrate 101.

It is to be understood that the socket device 1 having grounding structure 12 as shown in FIGS. 3B and 3C can be formed when the substrate 101 is a part of the base 10 and the sidewall 102 has socket structure 11 disposed thereon. However, if merely a substrate 101 is provided, the grounding structure 12 disposed on the substrate 101 can be applied to various kind of electronic devices or apparatus. In other words, the grounding structure 12 can be applied in any electronic device or apparatus having grounding requirement, so as to ensure the using security.

Please refer to FIGS. 3B, 3C and 3D, wherein FIGS. 3B and 3C are schematic diagrams respectively showing the inner and outer side of the assembled socket device shown in FIG. 1, and FIG. 3D is the schematic diagram showing a-a' section of the grounding structure of the socket device shown in FIGS. 3B and 3C of the present invention. As shown in FIGS. 3C and 3D, when the grounding structure 12 is assembled to the substrate 101, the substrate 101 is substantially placed between the contact surface 1213 of the grounding element 121 and the fixing portion 1221 of the fixing element 122. The grounding element 121 can be firmly fixed on the substrate 101 by the contact surface 1213 inlaid in the first indentation 1011 of the substrate 101, the neck 1214 engaged with the hollow portion 1010, and the second terminal 1212 fixed to the fixing portion 1221 of the fixing element 122. The first terminal 1211 of the grounding element 121 is protruded relative from the first lateral 101*a* of the substrate 101, and the groove 1215 is substantially adjacent to the first lateral 101*a* of the substrate 101. The second terminal 1212 of the grounding element 121, the fixing element 122, and the first conductive end 1231 of the grounding wire 123 are substantially inlaid in the second indentation 1012 of the second lateral 101*b* of the substrate 101. Since the receiving portion 1013 is corresponded to the insulating plate 124, the insulating plate 124 can be disposed in the receiving portion 1013 and substantially coplanar with the second lateral 101*b* of the substrate 101 for covering the second terminal 1212 of the grounding element 121, the fixing element 122, and the first conductive end 1231 of the grounding wire 123. Thus the second terminal 1212, the fixing element 122, and the first conductive end 1231 can be isolated. In addition, since the second conductive end 1232 of the grounding wire 123 penetrates through the insulating plate 124 and is protruded from the insulating plate 124, the second conductive end 1232 can be applied for grounding (as shown in FIG. 3B).

Accordingly, compared with the conventional grounding structure having conducting piece extended from the edge of the insulating shell, since a creepage distance D (the shortest distance from the aperture 1241 to the edge of the insulating plate 124) is created due to the grounding wire 123 piercing through the insulating plate 124, the distance between the grounding structure 12 belonging to the secondary side and the adjacent electronic components belonging to the primary side can be increased as well, so as to enhance the electrical security. In addition, since the insulating layer 1230 of the grounding wire 123 is engaged within the aperture 1241 of the insulating plate 124 for forming a continuous insulating structure, the process for sheathing insulating tube on the conducting piece and wire connected thereto in the conventional technique can be omitted. Moreover, because the insulating plate 124 can be received in the receiving portion 1013 and substantially coplanar with the second lateral 101*b* of the substrate 101, the problem of volume occupied by the insulating shell can be overcome.

Figure 2C:
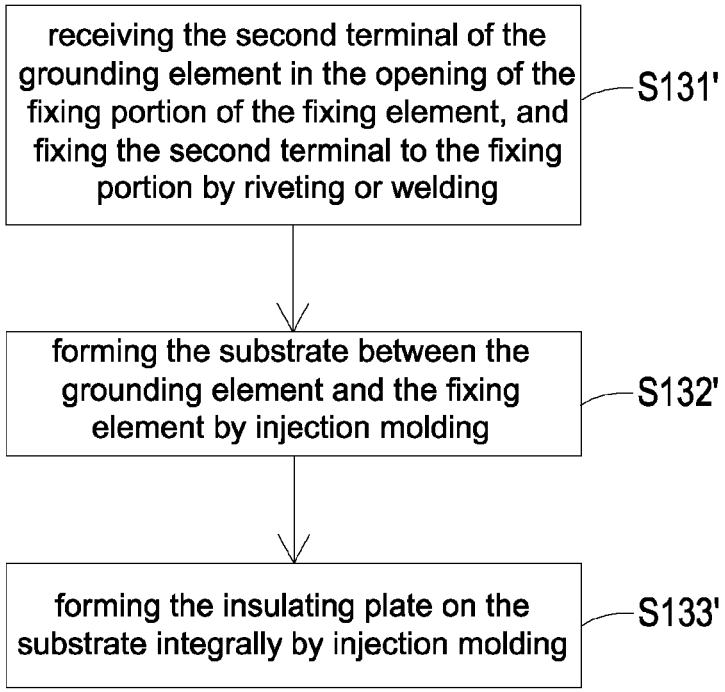
FIG. 2C is a flow chart showing sub steps of step S13 in FIG. 2A according to another embodiment.
Figure 4:
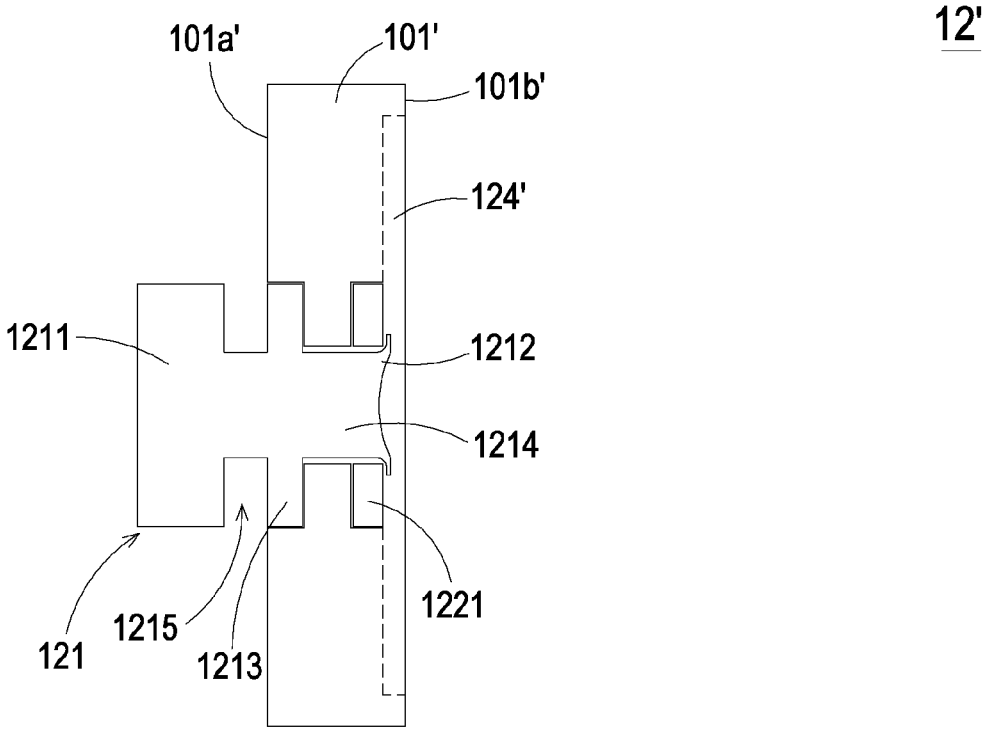
FIG. 4 is a schematic diagram showing the sectional view of the grounding structure of the socket device manufactured by the methods shown in FIGS. 2A and 2C of the present invention.

Of course, the present invention is not limited to the foregoing embodiment. Please refer to FIGS. 2A, 2C, and FIG. 4, wherein FIG. 2C is a flow chart showing sub steps of step S13 in FIG. 2A according to another preferred embodiment, and FIG. 4 is a schematic diagram showing the sectional view of the grounding structure of the socket device manufactured by the method shown in FIGS. 2A and 2C. As shown in FIG. 2A, a grounding element 121 and fixing element 122 have to be applied for manufacturing the grounding structure 12' applied in the socket device 1 (step S11). The grounding wire 123 is provided and the first conductive end 1231 of the grounding wire 123 is connected to the fixing element 122 (step S12), for example, the extension portion 1222 of the fixing element 122. Then the grounding element 121, the fixing element 122 and the substrate 101' are assembled for placing the substrate 101' between the grounding element 121 and the fixing element 122. The insulating plate 124' is then covered the fixing element 122 and the first conductive end 1231 of the grounding wire 123, wherein the grounding wire 123 is further piercing through insulating plate 124' (step S13).

In this embodiment, the structures of the grounding element 121, the fixing element 122, and the grounding wire 123 are similar to that described in the preferred embodiment shown in FIG. 1. In addition, the connecting relationships among the grounding element 121, the fixing element 122 and the grounding wire 123 are substantially the same as that described in the preferred embodiment shown in FIG. 1 as well. Except the manners for assembling the grounding element 121, the fixing element 122, the substrate 101', and the insulating plate 124' are slightly different. As shown in FIG. 2C, the second terminal 1212 of the grounding element 121 can be received in the opening 1220 of the fixing portion 1221 of the fixing element 122, and the second terminal 1212 can be firmly fixed to the fixing portion 1221 by riveting or welding (step S131'). The assembled grounding element 121 and fixing element 122 having the first conductive end 1231 of the grounding wire 123 connected thereto can be disposed in a mold (not shown), so as to form the substrate 101' placing between the grounding element 121 and the fixing element 122 by injecting plastic into the mold (step S132'). In this embodiment, the contact surface 1213, the neck 1214 and the second terminal 1212 of the grounding element 121, the fixing portion 1221 and the extension portion 1222 of the fixing element 122, and the first conductive end 1231 of the grounding wire 123 can be received in the mold, whereas the first terminal 1211 and the groove 1215 of the grounding element 121 and the second conductive end 1232 and parts of the insulating layer 1230 of the grounding wire 123 can be exposed relative to the mold. Therefore, the first terminal 1211 of the grounding element 121 is substantially protruded relative from the first lateral 101*a'* of the substrate 101' after the substrate 101' is formed, and the groove 1215 is approximately adjacent to the first lateral 101*a'* of the substrate 101'. The contact surface 1213 is substantially inlaid on the substrate 101', and the neck 1214 is buried in the substrate 101'. As to the fixing element 122 and the first conductive end 1231 of the grounding wire 123, they are substantially inlaid on the second lateral 101*b*' of the substrate 101' (as shown in FIG. 4). The insulating plate 124' is formed by injection molding as well, so as to integrally form the insulating plate 124' on the second lateral 101*b*' of the substrate 101' (step S133'). Thus, the second terminal 1212 of the grounding element 121, the fixing element 122, and the first conductive end 1231 of the grounding wire 123 can be covered by the insulating plate 124'. Since the second conductive end 1232 and parts of the insulating layer 1230 of the grounding wire 123 are exposed relative to the mold (not shown), it is known that the grounding wire 123 is partially protruded relative from the insulating plate 124' after the insulating plate 124' is formed, wherein the insulating layer 1230 is engaged with the insulating plate 124' and the second conductive end 1232 can be applied for grounding. Moreover, since the substrate 101' and the insulating plate 124' are both formed by injection molding in this embodiment, it is preferably that the steps S132' and S133' are performed simultaneously by injecting plastic in a mold (not shown).

FIG. 5 is a schematic diagram showing the socket device comprising the grounding structure applied in an electronic apparatus according to a preferred embodiment of the present invention. As shown in FIG. 5, the electronic apparatus 2 is preferably an adapter, but not limited thereto. The electronic apparatus 2 comprises not only the socket device 1 but also a main body 21 and a plug 22. The base 10 of the socket device 1 can be disposed on the main body 21 and defining a receiving space 20 together with the main body 21 for receiving the circuit board 23. The second conductive end 1232 of the grounding wire 123 of the grounding structure 12 of the socket device 1 can be directly connected to the grounding area 231, for example: grounding pad, of the circuit board 23 for grounding. Besides, the separation of the second conductive end 1232 and the grounding area 231 can be avoided while the electronic apparatus 2 is impacted due to the flexibility of the grounding wire 123. In some other embodiments, the second conductive end 1232 of the grounding wire 123 can be inserted into the grounding area 231 of the circuit board 23 for grounding. The plug 22 of the electronic apparatus 2 comprises a guiding portion 220, which cooperates to the groove 1215 and the first terminal 1211 of the grounding element 121 protruded from the first lateral 101*a* of the substrate 101. Therefore, the first terminal 1211 of the grounding element 121 can be applied as a grounding terminal, and the plug 22 can be led to the correct position by the groove 1215 cooperated with the guiding portion 220, so as to assemble the plug 22 and the socket device 1 and electrically connect the first and second conductive pieces 221, 222 with the first and second pins 111, 112 of the socket structure 11. Of course, the socket device 1 having grounding structure 12/12' can be applied to various electronic apparatus or equipment with grounding requirement to ensure the using safety thereof.

To sum up, the grounding element is firmly disposed on the substrate by the contact surface props against and being received in the first indentation on the first lateral of the substrate, the neck engaged within the hollow portion of the substrate, and the second terminal fixed to the fixing portion of the fixing element, so that the substrate can be tightly placed between the grounding element and the fixing element. Therefore, a firm grounding structure can be derived. In addition, the first conductive end of the grounding wire is connected to the extension portion of the fixing element. The second terminal of the grounding element, the fixing element and the first conductive end of the grounding wire are further covered by the insulating plate, and the grounding wire partially pierces through and protruded relative from the insulating plate, so as to form a continuous insulating structure by the insulating layer of the grounding wire engaged with the insulating plate. Thus, the process of sheathing insulating tube on the conducting piece and the wire connected thereto in the conventional manufacturing methods is no more required. In other words, the manufacturing method can be simplified. Besides, the electrical safety problem caused by the insulating tube being pierced through can be avoided.

Moreover, since the fixing element and the first conductive end of the grounding wire can be received in the second indentation of the substrate, and the insulating shell used in the conventional structure is replaced by the insulting plate coplanarly disposed on the second lateral of the substrate, the problem of volume occupied by the insulating shell can be overcome. Accordingly, the thickness of the grounding structure can be reduced, so as to minimize the size of socket device having grounding structure and the electronic apparatus having such socket device. Of course, the interior volume of the electronic apparatus can be increased for better utilization. Furthermore, in comparison with the conventional structure having conducting piece extended from the edge of the insulating shell, the creepage distance of the present invention can be increased due to the grounding wire penetrating through the insulating plate with insulating layer engaged with the insulating plate. Since the foregoing advantages cannot be achieved by the conventional techniques, the socket device comprising grounding structure, application of socket device and manufacturing method thereof are novel and non-obvious.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A socket device comprising a grounding structure, said socket device comprising:

a base, said base comprising a substrate and a sidewall adjacent to said substrate, said substrate comprising a first lateral and a second lateral corresponded to each other;

a socket structure disposed on said sidewall of said base; and said grounding structure disposed on said substrate of said base, said grounding structure comprising:

a grounding element comprising a first terminal and a second terminal, said first terminal protruded from said first lateral of said substrate;

a fixing element substantially disposed on said second lateral of said substrate and connected to said second terminal of said grounding element, so as to fix said grounding element to said substrate;

a grounding wire connected to said fixing element by a first conductive end thereof; and an insulating plate substantially disposed on said second lateral of said substrate and covered said second terminal of said grounding element, said fixing element and said first conductive end of said grounding wire, wherein said grounding wire is piercing through and protruded relative from said insulating plate for grounding.

2. The socket device according to claim 1 wherein said grounding element of said grounding structure further comprises:

a contact surface disposed between said first terminal and said second terminal;

a neck connecting said second terminal and said contact surface, said neck further comprising plural dents; and a groove disposed between said contact surface and said first terminal.

3. The socket device according to claim 2 wherein said fixing element of said grounding structure further comprises:

a fixing portion comprising an opening;

an extension portion extended from the edge of said fixing portion, so as to connect to said first conductive end of said grounding wire.

4. The socket device according to claim 3 wherein said substrate of said base comprises:

a hollow portion penetrating through said first lateral and said second lateral;

a first indentation surrounding said hollow portion and depressed from said first lateral of said substrate; and a second indentation surrounding said hollow portion and depressed from said second lateral of said substrate.

5. The socket device according to claim 4 wherein said fixing element and said first conductive end of said grounding wire of said grounding structure are received in said second indentation of said substrate, said opening of said fixing element is corresponded to said hollow portion of said substrate, said contact surface of said grounding element is received in said first indentation of said substrate, said neck is engaged within said hollow portion, and said second terminal is received in said opening of said fixing element and fixed to said fixing element.

6. The socket device according to claim 4 wherein said second indentation of said substrate of said base further comprises a first part and a second part, said fixing portion of said fixing element of said grounding structure is received in said first part, and said extension portion of said fixing element and said first conductive end of said grounding wire are received in said second part.

7. The socket device according to claim 4 wherein said substrate of said base further comprises a receiving portion disposed on said second lateral of said substrate and corresponded to said insulating plate of said grounding structure, said second indentation is disposed in said receiving portion.

8. The socket device according to claim 7 wherein at least a protrusion is disposed in said receiving portion of said substrate, and said insulating plate further comprises at least a through hole corresponded to said protrusion, said protrusion is received in said through hole so that said insulating plate is disposed in said receiving portion and covers said second terminal of said grounding element, said fixing element and said first conductive end of said grounding wire.

9. The socket device according to claim 1 wherein said insulating plate is selected from an insulating pad or an insulating tape.

10. The socket device according to claim 1 wherein said insulating plate of said grounding structure is integrally formed with said substrate of said base.

11. The socket device according to claim 1 wherein said insulating plate of said grounding structure further comprises an aperture for said grounding wire to penetrate therethrough, and said grounding wire of said grounding structure further comprises a second conductive end for grounding and an insulating layer, said second conductive end is corresponded to said first conductive end, and said insulating layer wraps said grounding wire between said first conductive end and said second conductive end and is engaged within said aperture of said insulating plate.

12. An electronic apparatus comprising:

a main body; and a socket device comprising:

a base, said base defining a receiving space with said main body, so as to receive a circuit board, said base comprising a substrate and a sidewall adjacent to said substrate, said substrate comprising a first lateral and a second lateral;

a socket structure disposed on said sidewall of said base; and a grounding structure disposed on said substrate of said base and comprising:

a grounding element comprising a first terminal and a second terminal, said first terminal protruded from said first lateral of said substrate;

a fixing element substantially disposed on said second lateral of said substrate and connected to said second terminal of said grounding element, so as to fix said grounding element relative to said substrate;

a grounding wire connected to said fixing element by a first conductive end thereof; and an insulating plate substantially disposed on said second lateral of said substrate and covered said second terminal of said grounding element, said fixing element and said first conductive end of said grounding wire, wherein said grounding wire is penetrating through and protruded relative from said insulating plate, so as to connect to said circuit board for grounding.

13. The electronic apparatus according to claim 12 wherein said grounding wire of said grounding structure of said socket device further comprises a second conductive end and an insulating layer, said second conductive end is corresponded to said first conductive end and connected to a grounding area of said circuit board for grounding, and said insulating layer wraps said grounding wire between said first conductive end and said second conductive end and is engaged with said insulating plate.

14. The electronic apparatus according to claim 12 wherein said grounding element of said grounding structure of said socket device further comprises a groove, and said electronic apparatus further comprises a plug having a guiding portion cooperated with said groove, said plug is guided by said groove while assembling to said socket device.

* * * * *